US012662927B2

(12) United States Patent
Brovko et al.

(10) Patent No.: US 12,662,927 B2
(45) Date of Patent: Jun. 23, 2026

(54) SYSTEMS AND METHODS FOR CONTROLLING A DOWNHOLE TOOL IN A DOWNHOLE ENVIRONMENT

(71) Applicant: Schlumberger Technology Corporation, Sugar Land, TX (US)

(72) Inventors: Ekaterina Brovko, Cheltenham (GB); Katharine Mantle, Cheltenham (GB); Maja Ignova, Cheltenham (GB); Martin Jones, Gloucester (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 50 days.

(21) Appl. No.: 18/883,063

(22) Filed: Sep. 12, 2024

(65) Prior Publication Data

US 2026/0071535 A1 Mar. 12, 2026

(51) Int. Cl.

| | |
|---|---|
| ***E21B 44/00*** | (2006.01) |
| ***E21B 7/04*** | (2006.01) |
| ***E21B 47/18*** | (2012.01) |

(52) U.S. Cl.

CPC ..... *E21B 44/00* (2013.01); *E21B 7/04* (2013.01); *E21B 47/18* (2013.01)

(58) Field of Classification Search

CPC . E21B 44/00; E21B 7/04; E21B 47/18; E21B 44/02; E21B 49/003; E21B 2200/20; E21B 2200/22

See application file for complete search history.

(56) References Cited

U.S. PATENT DOCUMENTS

| | | | | |
|---|---|---|---|---|
| 10,533,409 | B2 * | 1/2020 | Benson | E21B 7/24 |
| 11,846,173 | B2 * | 12/2023 | Hoehn | E21B 7/06 |
| 2006/0185900 | A1 * | 8/2006 | Jones | E21B 47/12 175/45 |
| 2015/0211352 | A1 | 7/2015 | Sugiura | |
| 2016/0160567 | A1 * | 6/2016 | Downton | E21B 44/005 175/73 |
| 2019/0085683 | A1 * | 3/2019 | Gillan | E21B 47/12 |
| 2020/0003010 | A1 * | 1/2020 | Bittleston | E21B 7/068 |
| 2020/0340355 | A1 * | 10/2020 | Han | E21B 47/24 |
| 2021/0180448 | A1 * | 6/2021 | Annenkov | E21B 7/18 |
| 2021/0324724 | A1 * | 10/2021 | Boone | E21B 7/04 |
| 2023/0243252 | A1 | 8/2023 | Benson | |
| 2023/0392447 | A1 * | 12/2023 | Ignova | E21B 47/024 |
| 2024/0026769 | A1 * | 1/2024 | Chen | E21B 44/00 |
| 2024/0352843 | A1 * | 10/2024 | Tasoujian | E21B 7/04 |
| 2026/0071535 | A1 * | 3/2026 | Brovko | E21B 44/00 |

FOREIGN PATENT DOCUMENTS

| | | | | |
|---|---|---|---|---|
| WO | WO-2023028207 A1 * | 3/2023 | | E21B 44/00 |
| WO | WO-2025059000 A1 * | 3/2025 | | E21B 7/06 |

* cited by examiner

*Primary Examiner* — Daniel P Stephenson
(74) *Attorney, Agent, or Firm* — Jeffrey D. Frantz

(57) ABSTRACT

A method may include drilling a portion of a borehole with a bottomhole assembly (BHA) including the downhole tool in an automated drilling routine. A method may include receiving, at a control unit of the BHA, a disengagement downlink communication having a disengagement magnitude and disengagement duration. A method may include, based at least partially on the disengagement downlink communication, disengaging the automated drilling routine.

6 Claims, 5 Drawing Sheets

SYSTEMS AND METHODS FOR CONTROLLING A DOWNHOLE TOOL IN A DOWNHOLE ENVIRONMENT

BACKGROUND

For drilling of a borehole, directional drilling allows creation of a non-linear borehole or a linear borehole through varying earth formations. Directional drilling units conventionally communicate with the surface to transmit status information and/or receive instructions through lengthy pulse communications. Reduction of communication time can increase the uptime of a drilling system.

SUMMARY

In some aspects, the techniques described herein relate to a method of controlling a downhole tool, the method including: drilling a portion of a borehole with a bottomhole assembly (BHA) including the downhole tool in an automated drilling routine; receiving, at a control unit of the BHA, a disengagement downlink communication having a disengagement magnitude and disengagement duration; and based at least partially on the disengagement downlink communication, disengaging the automated drilling routine.

In some aspects, the techniques described herein relate to a method of controlling a downhole tool, the method including: drilling a portion of a borehole with a bottomhole assembly (BHA) including the downhole tool in an automated drilling routine, wherein a downhole drill state (DHDS) of the downhole tool is set to a first value; receiving, at a control unit of the BHA, at least one drilling mechanic; and based at least partially on the at least one drilling mechanic, transmitting instructions from the control unit to the downhole tool to set the DHDS to a second value.

In some aspects, the techniques described herein relate to a downhole system including: a directional steering tool; and a control unit including: a processor, a hardware storage device having instructions stored thereon executable by the processor to cause the control unit to: drill a portion of a borehole with a bottomhole assembly (BHA) including the directional steering tool in an automated drilling routine; receive a disengagement downlink communication having a disengagement magnitude and disengagement duration; and based at least partially on the disengagement downlink communication, transmit instructions to the directional steering tool to disengage the automated drilling routine.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and aspects of embodiments of the disclosure will be set forth in the description which follows, and in part will be obvious from the description, or may be learned by the practice of such embodiments. The features and aspects of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure, but not to scale for other embodiments contemplated herein. Understanding that the drawings depict some example embodiments, the embodiments will be described and explained with additional specificity and detail through the use of the accompanying drawings in which.

DETAILED DESCRIPTION

Figure 1:
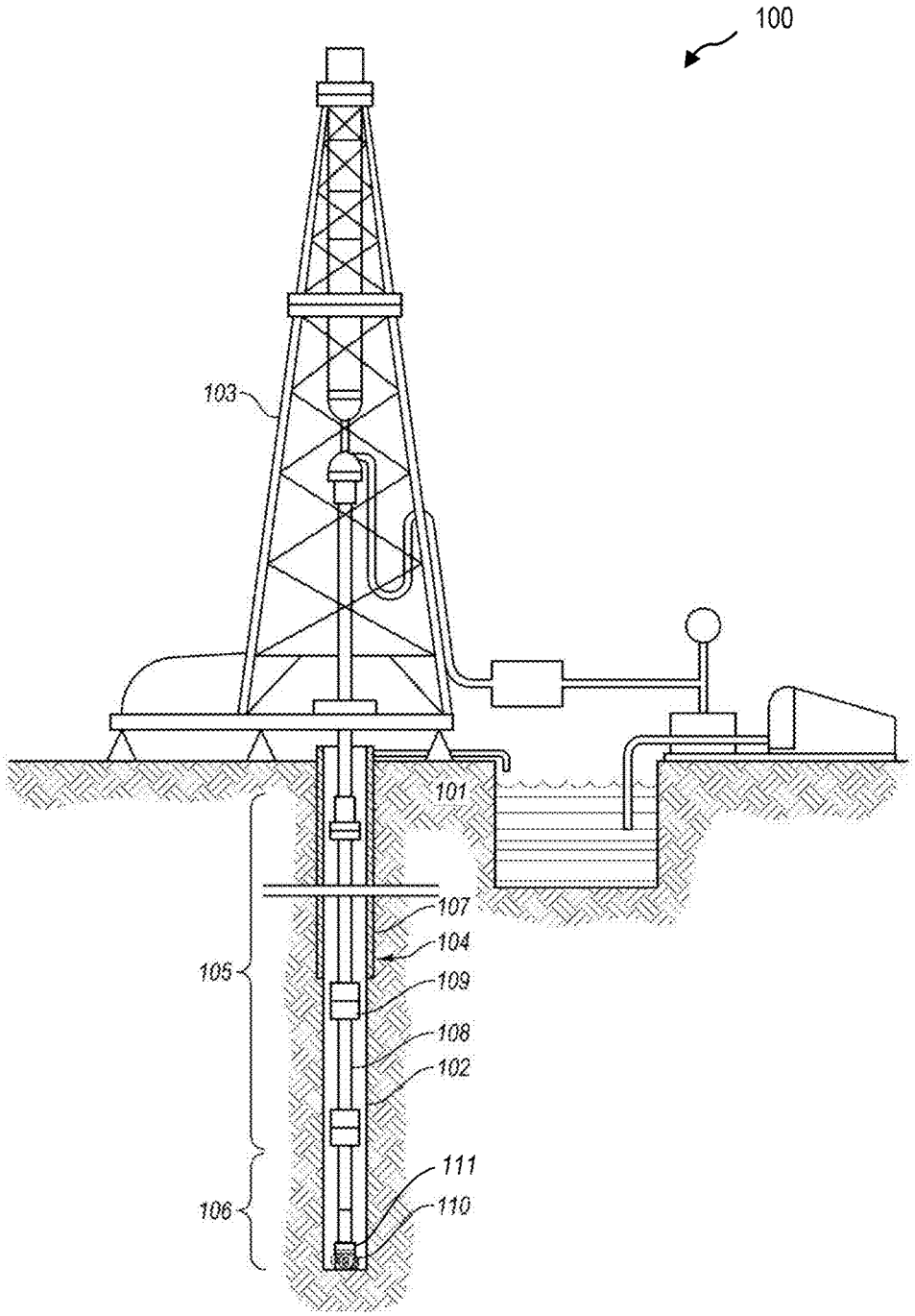
FIG. 1 illustrates a drilling system and downhole environment, according to some embodiments of the present disclosure.

Embodiments of the present disclosure generally relate to devices, systems, and methods for controlling a downhole tool in a downhole environment. In some embodiments, methods and systems, according to the present disclosure, include a control unit in the downhole environment receiving or detecting a communication to control at least a portion of a bottomhole assembly. More particularly, the control unit sends transmissions to at least one other component of the bottomhole assembly based on determining a downhole drill state (DHDS) of the drilling system.

Automated drilling routines based on one or more predetermined stages or a pre-determined well plan can limit downhole communications and increase uptime of the drilling system. However, downhole environments are variable and the effects on the drilling system and components of the drilling system can be unexpected. Furthermore, communication with a bottomhole assembly (BHA) or other downhole components of the drill string can present a challenge when hundreds or thousands of meters from the surface controls. Reliable, fast, and robust control of engagement and disengagement of the automated drilling routines is desirable.

In some embodiments, an automated drilling routine automatically adjusts one or more operating parameters of a downhole component, such as a directional steering tool, turbine, or mud motor to change a rate of penetration (ROP) of a drill bit or a direction and/or radius of curvature of the borehole during drilling. For example, an automated drilling routine may target a pre-determined azimuth and/or inclination for the borehole being drilled. The directional steering tool may actuate steering pads or other features to urge the drill bit in the direction of the target azimuth and/or inclination. By acting over a period of time, a gradual curve can be created in the borehole to meet the target azimuth and/or inclination before a target location is reached and/or a target distance is drilled.

In some embodiments, the directional steering tool and/or other downhole components can measure the rotational orientation of the directional steering tool and/or other downhole components but may be uninformed of the longitudinal position of the BHA in the borehole and the actual ROP (and longitudinal speed) of the BHA and/or drill string through the formation. In the event that the directional steering tool and/or other downhole components are not changing orientation when expected (i.e., not moving through a curve), the automated drilling routine may attempt to compensate for the difference between the targeted changes and the measured changes by adjusting (e.g., increasing) a targeted dogleg severity (DLS) and/or ROP.

More particularly, some automated drilling routines include ramping ROP and/or DLS based on time and progress toward a target value or target location. If the drill string is not advancing (e.g., during connection of a stand, idling, rotating off-bottom, or reaming), the drilling system can continue ramping the DLS and ROP progressive more and more, causing a runaway DLS and/or runaway ROP. In some examples, the directional steering tool and/or other downhole components can erroneously determine the BHA is not effectively turning through the formation when the drilling system is, in actuality, not drilling, at all. In some instances, transmitting a conventional downlink communication to change the automated drilling routine settings and/or reset values can require a 25-minute sequence of downlink communications. Determining when the drilling system is not drilling the formation and changing a DHDS of the drilling system and/or BHA without a lengthy downlink communication can save time and prevent unintended changes to the DLS and/or ROP.

In some embodiments, a drilling rig or other component of the drilling system at surface transmits a single downlink communication to the control unit. The single downlink communication instructs the control unit to disengage at least one active automated drilling routine. For example, the single downlink communication may be a unique downlink communication that is discernable by the control unit as a complete downlink communication, and, in response to the single downlink communication, the control unit disengages the automated drilling routine and sets the directional steering tool and/or other downhole components to manual control to await further downlink communications. In some embodiments, the control unit disengages the automated drilling routine and changes a DHDS of the directional steering tool and/or other downhole components. In at least one example, a DHDS of the directional steering tool and/or other downhole components instructs the directional steering tool and/or other downhole components when the drilling system is drilling or not drilling. In at least one example, the DHDS has further non-drilling states, such as instructing the directional steering tool and/or other downhole components when the drilling system is reaming or connecting a stand of pipe to the drill string.

In at least one embodiment, the single downlink communication is a rotations-per-minute (RPM) pulse. For example, an RPM pulse can allow a downlink communication when drilling fluid (e.g., mud) flow rate and/or pressure is unreliable. In some examples, an operator may need to stop an automated drilling routine because of a loss of control of the mud flow rate and/or pressure. A single RPM pulse, such as a pre-determined RPM for a pre-determined duration (200 RPM for 60 seconds), can allow the operator to transmit a disengagement command to the control unit and BHA even when mud pulses are unreliable or impossible.

In at least one embodiment, the single downlink communication is a mud pulse. For example, a mud pulse can allow a downlink communication when an RPM pulse is unreliable. In some examples, an operator may need to stop an automated drilling routine because of stick-slip mechanics or other drilling mechanics that affect the rotational speed of at least a portion of the downhole assembly. In such an example, the challenge causing the need to disengage the automated drilling routine also can inhibit conventional communications. A single mud pulse, such as a pre-determined mud pressure for a pre-determined duration (e.g., 2000 pounds per square inch for 60 seconds), can allow the operator to transmit a disengagement command to the control unit and BHA even when RPM pulses are unreliable or impossible.

In some embodiments, the control unit determines and changes a DHDS based on one or more drilling conditions measured or received at the control unit in the downhole environment without a downlink communication. For example, the control unit may receive or detect a collar RPM value proximate to the BHA and determine, based at least partially on the collar RPM value, that a connection of additional drill pipe is being made at the drilling rig. The control unit may change a DHDS value of a directional steering tool and/or other downhole components to pause or terminate an automated drilling routine. For example, the control unit may transmit instructions to the directional steering tool to stop actuation of steering pads while the DHDS is set to a not drilling value. In some examples, the control unit may transmit instructions to the directional steering tool to limit and/or prevent any changes to a DLS while the DHDS is set to a not drilling value. In some examples, the control unit may transmit instructions to the directional steering tool to set a DHDS value of the directional steering tool to a not drilling value, and the directional steering tool changes one or more operations of the directional steering tool based at least partially on the DHDS value.

As described herein, an operator may disengage an automated drilling routine due to measured drilling mechanics in the downhole environment, such as stick-slip mechanics or other measured vibrations or variations in drill string RPM. In some embodiments, the control unit receives and/or measures one or more drilling mechanics values and determines a DHDS of the drilling system. For example, a lower torquer of the drill string receives mud flow and converts the fluid pressure to torque on a lower portion of the drill string. The torque generated by the lower torquer rotates the drill bit in addition to any surface (e.g., drilling rig) RPM. In some embodiments, the control unit receives a torque and/or flow rate of drilling fluid through the lower torquer. When the lower torquer flow rate is different from an expected drilling flow rate or a downlink flow rate (i.e., mud pulses), the control unit may determine that a stick-slip condition is occurring. As anti-jamming procedures require temporary cessation of on-bottom drilling, the control unit determines the DHDS value to be "not drilling".

FIG. 1 illustrates an embodiment of a drilling system and downhole environment. FIG. 1 shows one example of a drilling system 100 for drilling an earth formation 101 to form a borehole 102. The drilling system 100 includes a drill rig 103 used to turn a drilling assembly 104 which extends downward into the borehole 102. The drilling assembly 104 may include a drill string 105 and a bottomhole assembly (BHA) 106 attached to the downhole end of the drill string 105. Where the drilling system 100 is used for drilling formation, a drill bit 110 can be included at the downhole end of the BHA 106.

The drill string 105 may include several joints of drill pipe 108 connected end-to-end through tool joints 109. The drill string 105 transmits drilling fluid through a central bore and can transmit rotational power from the drill rig 103 to the BHA 106. In some embodiments, the drill string 105 may further include additional components such as subs, pup joints, etc. The drill pipe 108 provides a hydraulic passage through which drilling fluid 111 is pumped from the surface. The drilling fluid 111 discharges through selected-size nozzles, jets, or other orifices in the bit 110 for the purposes of cooling the bit 110 and cutting structures thereon, for lifting cuttings out of the borehole 102 as it is being drilled, and for preventing the collapse of the borehole 102. The drilling fluid 111 carries drill solids including drill fines, drill cuttings, and other swarf from the borehole 102 to the surface. The drill solids can include components from the earth formation 101, the drilling assembly 104 itself, from other man-made components (e.g., plugs, lost tools/components, etc.), or combinations thereof.

The BHA 106 may include the bit 110 or other components. An example BHA 106 may include additional or other components (e.g., coupled between to the drill string 105 and/or the bit 110). Examples of additional BHA components include drill collars, stabilizers, measurement-while-drilling (MWD) tools, logging-while-drilling (LWD) tools, downhole motors, underreamers, directional steering tools, section mills, hydraulic disconnects, jars, vibration dampening tools, other components, or combinations of the foregoing.

In general, the drilling system 100 may include other drilling components and accessories, such as special valves (e.g., kelly cocks, blowout preventers, safety valves, centrifuges, shaker tables, and rheometers). Additional components included in the drilling system 100 may be considered a part of the surface system (e.g., drill rig 103, drilling assembly 104, drill string 105, or a part of the BHA 106, depending on their locations and/or use in the drilling system 100).

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits, roller cone bits, impregnated bits, or coring bits. In other embodiments, the bit 110 may be a mill used for removing metal, composite, elastomer, other materials downhole, or combinations thereof. For instance, the bit 110 may be used with a whipstock to mill into casing 107 lining the borehole 102. The bit 110 may also be a junk mill used to mill away tools, plugs, cement, other materials within the borehole 102, or combinations thereof. Swarf or other cuttings formed by use of a mill may be lifted to surface by the drilling fluid 111 or may be allowed to fall downhole. The conditions of the equipment of the drilling system 100, the formation 101, the borehole 102, the drilling fluid 111, or other part of the wellsite can change during operations.

Figure 2:
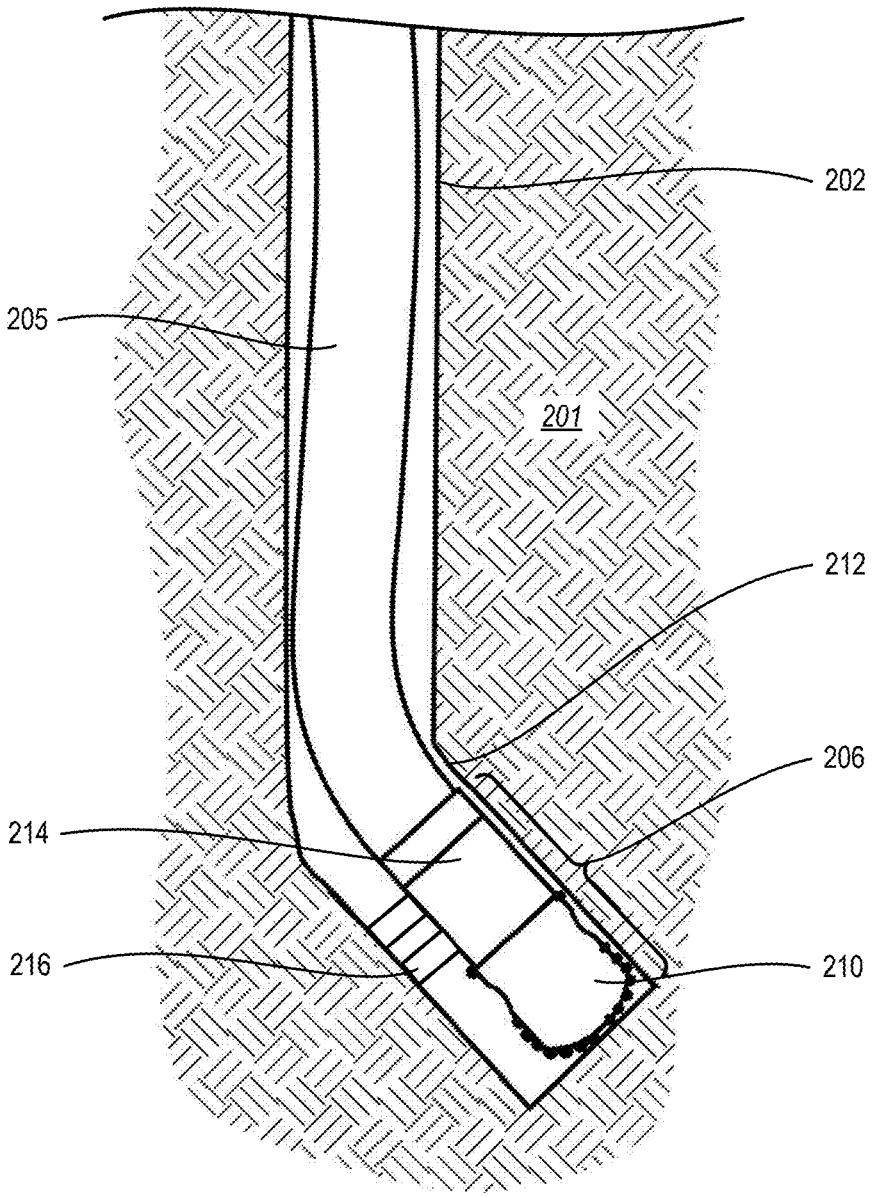
FIG. 2 is a side view of a downhole environment in which a bottomhole assembly (BHA) and drill string steer the bit to create a curve of a borehole, according to some embodiments of the present disclosure.

In some embodiments, the BHA 106 includes one or more biasing units that allow an operator to steer the bit 110 relative to the earth formation 101 as the drilling assembly 104 rotates in the borehole 102. For example, FIG. 2 is a side view of an embodiment of a downhole environment in which a BHA 206 and drill string 205 steer the bit 210 to create a curve of a borehole 202.

In some embodiments, a portion of the BHA 206 and/or drill string 205 contacts a radially inward surface 212 of the borehole 202 as the BHA 206 and drill string 205 follow the curve. In some embodiments, when the BHA 206 and drill string 205 contact the formation 201 of the borehole surface, the BHA 206 and drill string 205 experience damage from the formation 201. In some embodiments, when the BHA 206 and drill string 205 contact the formation 201 of the borehole surface, the BHA 206 and drill string 205 experience drag, in the longitudinal direction and/or the rotational direction, placing additional strain on the drilling system and components thereof. Precise control of steering the BHA 206 and the bit 210 with a directional steering tool 214 allows the drilling system to limit and/or prevent damage to the BHA 206 and drill string 205 in non-linear boreholes 202. In some embodiments, automated drilling routines can produce too high of a DLS when attempting to meet a target.

In some embodiments, a directional steering tool 214 is a discrete steering tool that is coupled to a drill bit 210. In some embodiments, the directional steering tool 214 is the drill bit with an integrated biasing element or steering element. For example, a directional steering tool 214 includes at least one actuatable biasing element 216 configured to actuate radially outward from a rotational axis of the BHA 206 and drill string 205. As the BHA 206 and drill string 205 rotate, the actuatable biasing element 216 is actuated between a closed position and an open position to selectively apply a lateral force to the borehole wall. The drill bit 210 is urged in an opposing lateral direction to steer the drill bit 210 and the direction of the borehole 202.

In some embodiments, an MWD unit allows for measurements of a plurality of operating conditions, environmental conditions, fluid measurements, or other status information regarding the performance and/or condition of the downhole tool and the downhole environment in which the downhole tool is operating. In some embodiments, the MWD unit measures and/or records directional information of the downhole tool. In some examples, the MWD unit includes accelerometers and/or magnetometers to measure the inclination and azimuth of the borehole at the measured location. In some embodiments, the MWD unit includes survey gyroscopes that allow directional and/or movement information, such as inclination, azimuth, velocity, and other values. In some embodiments, the MWD unit records the directional measurements. In some embodiments, the MWD unit transmits the measurements to a system and/or operator at the surface.

In some embodiments, the MWD unit measures and/or records drilling mechanics information. In some embodiments, the drilling mechanics information includes a rotational speed (e.g., RPM) of the drill string and/or drill bit; variation (vibration) in the rotational speed; amplitude, frequency, and mode of vibrations of the drill string; downhole temperature; torque on bit; weight on bit; mud flow volume; other drilling mechanics information; and combinations thereof. In some embodiments, the MWD unit records the drilling mechanics information or reports the drilling mechanics information to a control unit in the BHA 206. In some embodiments, the MWD unit transmits the drilling mechanics information to a system and/or operator at the surface.

Figure 3:
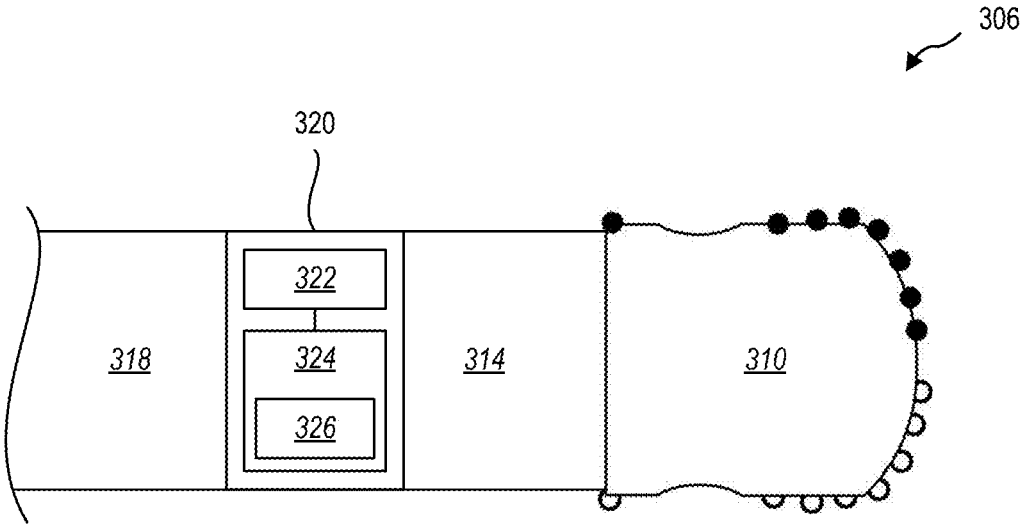
FIG. 3 is a system diagram of a BHA including a control unit, according to some embodiments of the present disclosure.

In some embodiments, the BHA includes a control unit configured to receive one or more of directional information, operating conditions, environmental conditions, fluid measurements, drilling mechanics information, or other status information, as illustrated in the embodiment of FIG. 3. In some embodiments, the control unit 320 is in data communication with at least one sensor (e.g., an MWD 318 including one or more sensors) and a directional steering tool 314. In some embodiments, the control unit 320 is integrated with the MWD 318 and/or the directional steering tool 314. The control unit 320 includes a processor 322 and a hardware storage device 324 in data communication with the processor 322. The hardware storage device 324 has instructions stored thereon that, when executed by the processor 322, cause the BHA 306 to perform at least a portion of any method described herein.

In some embodiments, the hardware storage device 324 has a plurality of stages and/or well plan 326 stored thereon. In some embodiments, the well plan 326 is loaded to the hardware storage device 324 at the surface of the drilling system prior to running the BHA 306 (including the control unit 320) downhole. In some embodiments, the well plan 326 includes a plurality of stages of the well plan 326. The control unit 320 obtains at least one of the directional information, operating conditions, environmental conditions, fluid measurements, drilling mechanics information, or other status information from one or more sensors of the BHA 306. In at least one example, the sensors are in or part of the MWD 318.

A formation measurement is, in some examples, a measurement of at least one property of the formation through which the BHA 306 is drilling or otherwise located. For example, a formation measurement includes a formation fluid composition, a formation solids composition (e.g., geochemistry), a formation hardness, a formation porosity, a formation fluid flow rate, a formation homogeneity, etc. In some embodiments, the formation measurement is made by one or more sensors of the BHA 306. In some embodiments, the formation measurement is made by sensors in the drill bit 310. In some embodiments, the formation measurement is made by sensors in the MWD 318. In some embodiments, the formation measurement is made by sensors in the directional steering tool 314.

An environmental measurement is, in some examples, a measurement of at least one property of the downhole environment that may or may not be related to the formation through which the BHA 306 drills or is located. For example, an environmental measurement may include temperature, pressure, or other measurements that are not formation measurements but inform the drilling system of downhole conditions. In some embodiments, the environmental measurement is made by one or more sensors of the BHA 306. In some embodiments, the environmental measurement is made by sensors in the drill bit 310. In some embodiments, the environmental measurement is made by sensors in the MWD 318. In some embodiments, the environmental measurement is made by sensors in the directional steering tool 314.

In some embodiments, the BHA 306 uses the plurality of stages and/or well plan 326 stored locally on the BHA 306 to determine target values, including target ROP and target DLS, of automated drilling routines.

Figure 4:
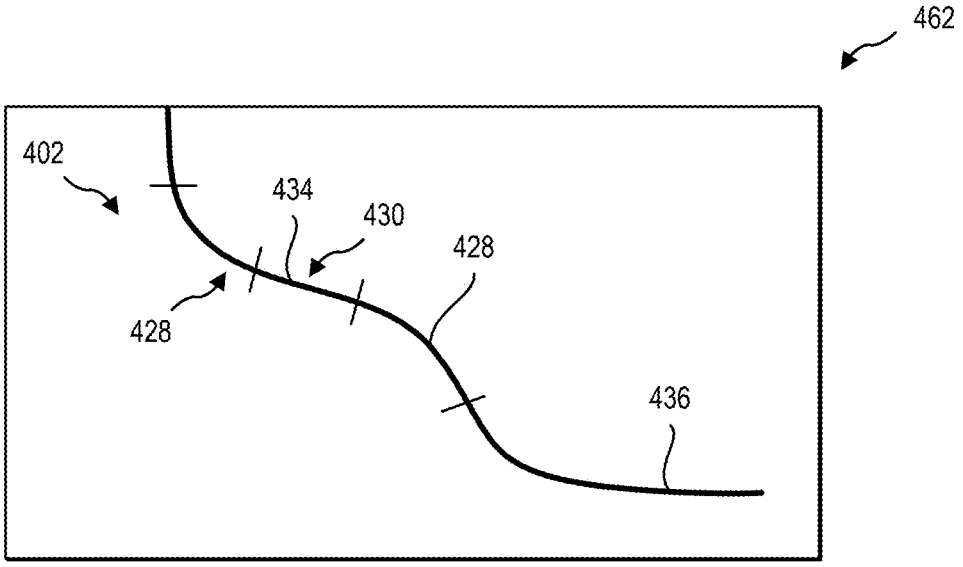
FIG. 4 is a schematic representation of an embodiment of a well plan stored on a hardware storage device of a control unit and/or BHA, according to some embodiments of the present disclosure.

FIG. 4 is a schematic representation of an embodiment of a well plan stored on a hardware storage device of a control unit and/or BHA described herein. In some embodiments, the well plan includes a plurality of stages with transitions therebetween. For example, the well plan may include a curved stage 428 and/or a linear stage 430. In some embodiments, the well plan includes a plurality of curved stages 428 and linear stages 430. In some embodiments, the well plan includes at least one vertical stage. In some embodiments, the well plan includes a landing stage 436. The directional steering tool and other components of the drill string directs the BHA and drill bit through the formation according to the inclination, azimuth, dogleg severity, rate of penetration, axial length along the stage, and other parameters of the well plan. Determining the location of the BHA in the well plan and/or a stage of the well plan can improve the accuracy of the drilling system.

A curved stage 428 is any stage of the well plan in which at least one of the inclination and the azimuth of the borehole 402 changes along a length of the stage. While the schematic illustration of FIG. 4 depicts an embodiment of a curved stage 428 with a change in inclination along a length of the curved stage 428, it should be understood that in some embodiments of a curved stage the inclination is substantially constant and the azimuth of the borehole 402 changes. In some embodiments, both the inclination and the azimuth of the borehole 402 changes in the curved stage 428.

A linear stage 430 is any stage of the well plan in which the inclination and azimuth of the borehole 402 remains constant along the length of the stage. In some embodiments, a linear stage 430 is a vertical stage of the well plan in which the inclination is substantially vertical relative to a direction of gravity. For example, a vertical stage may be an initial stage from the surface. In some embodiments, a linear stage 430 of the well plan is a directional stage 434 in which the inclination and azimuth are substantially constant, while the inclination is non-vertical, creating a lateral net movement of the borehole 402 along the length of the directional stage 434 relative to the direction of gravity.

In some embodiments, the well plan includes a landing stage 436. In some embodiments, the landing stage 436 is a curved stage in which the borehole 402 attains a substantially horizontal orientation relative to the direction of gravity. In some embodiments, the landing stage 436 is a final stage of the well plan.

Figure 5:
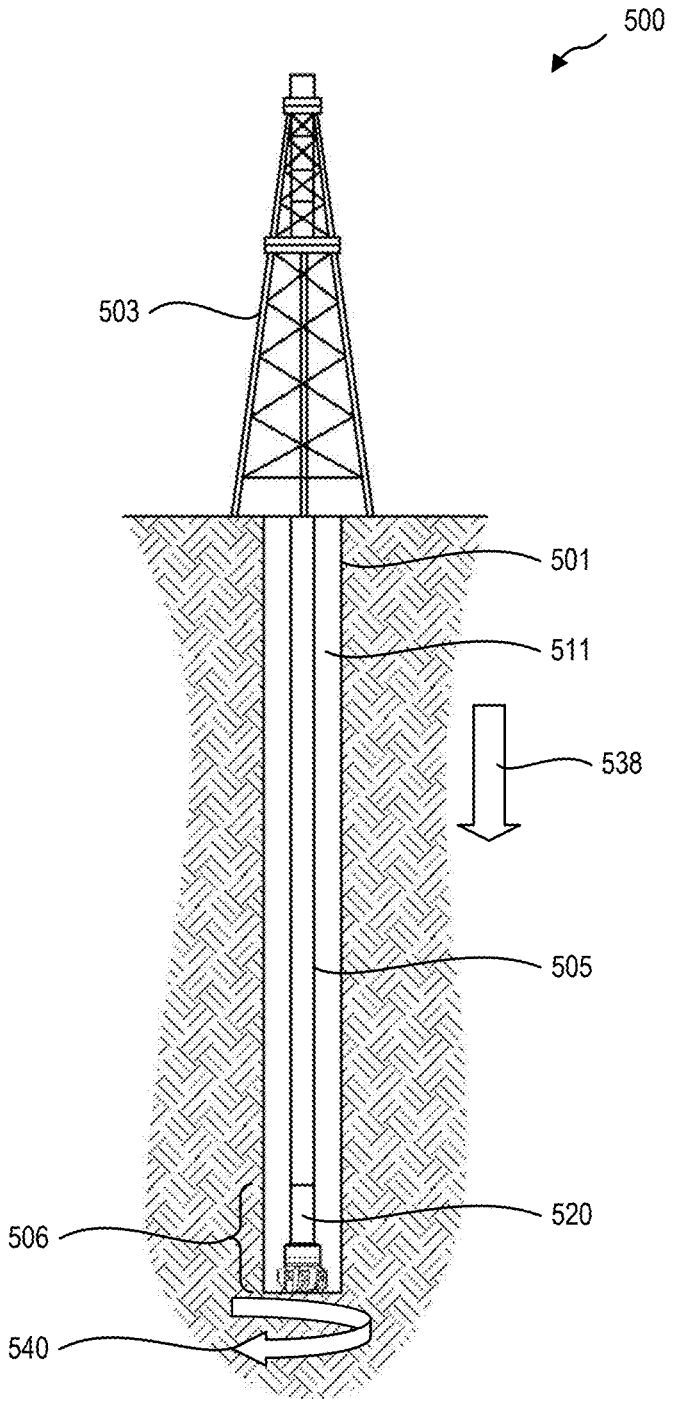
FIG. 5 is an embodiment of a downlink communications from a surface of a drilling system to a BHA, according to some embodiments of the present disclosure.

FIG. 5 is an embodiment of a downlink communications from a surface of a drilling system 500 to a BHA 506. In some embodiments, the drilling system 500 can communicate downhole with the control unit 520 and/or BHA 506 by mud pulses 538. For example, a drilling fluid 511 or mud flows downward through the drill string 505 to the control unit 520 and/or BHA 506 as described herein. By varying a flow rate and/or a fluid pressure of the drilling fluid 511, the drilling rig 503 at the surface of the drilling system 500 can transmit instructions to the control unit 520 and/or BHA 506. In a conventional system, the downlink communication includes a plurality of mud pulses 538 in the downhole direction, where each mud pulse 538 is of varying duration to communicate or select settings in the BHA 506. In some examples, the borehole 501 and/or drill string 505 can be long, introducing fluidic drag into the mud pulses 538, requiring each mud pulse to be a minute or longer. A sequence of mud pulses 538, therefore, can take several minutes or longer to communicate a relatively simple change to BHA settings.

In some embodiments, the drilling system 500 can communicate downhole with the control unit 520 and/or BHA 506 by RPM pulses 540. For example, the drilling rig 503 applies a torque to change the revolutions per minute (RPM)

of the drill string 505 to communicate with the control unit 520 and/or BHA 506. By varying an RPM of the drill string 505 through a series of changes or at a particular RPM, the drilling rig 503 at the surface of the drilling system 500 can transmit instructions to the control unit 520 and/or BHA 506. In a conventional system, the downlink communication includes a plurality of RPM pulses 540, where each RPM pulses 540 is of varying duration and/or RPM to communicate or select settings in the BHA 506. In some examples, the borehole 501 and/or drill string 505 can be long, introducing significant torsional elasticity, fluidic drag, friction with a borehole wall and other variables into the communication of the transmission of the RPM pulse 540 in the downhole direction. The delay and/or noise (e.g., torsional oscillations) in the transmission of the RPM pulses 540 can require each RPM pulse 540 to be a minute or longer to effectively communicate the signal to the control unit 520 and/or BHA 506. A sequence of RPM pulses 540, therefore, can take several minutes or longer to communicate a relatively simple change to BHA settings.

Figure 6:
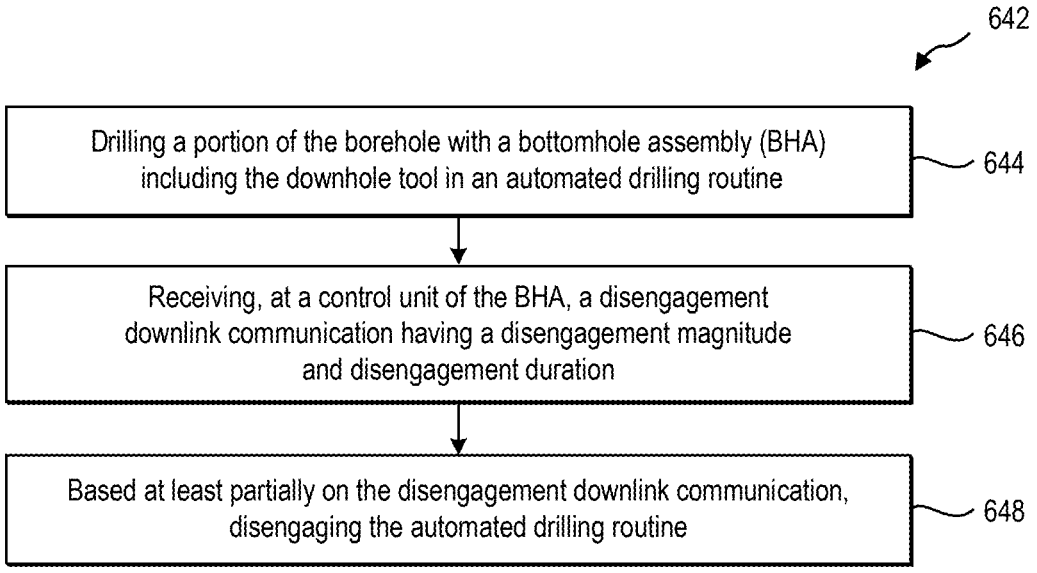
FIG. 6 is a flowchart illustrating a method of controlling a downhole tool, according to some embodiments of the present disclosure.

FIG. 6 is a flowchart illustrating an embodiment of a method 642 of controlling a BHA in a downhole environment. In some embodiments, the method 642 includes drilling a portion of the borehole with a BHA including a downhole tool in an automated drilling routine at 644. In some embodiments, after drilling the portion of the borehole, the method 642 includes receiving, at the control unit of the BHA, a disengagement downlink communication at 646. In some embodiments, the disengagement downlink communication has a pre-determined disengagement magnitude and disengagement duration. In some embodiments, at least one of the disengagement magnitude and the disengagement duration is unique among downlink communications recognized by the BHA. For example, the disengagement downlink communication may have a disengagement magnitude that is greater than any other recognized downlink communication. In at least one example, the disengagement magnitude is at least 2000 psi. In at least one example, the disengagement magnitude is at least 200 RPM.

As described herein, in some embodiments, the disengagement downlink communication is an RPM pulse. For example, the disengagement downlink communication may be an RPM pulse with a disengagement magnitude of an RPM value and a disengagement duration for which the RPM value is maintained. In some embodiments, at least one of the disengagement magnitude and the disengagement duration is unique among downlink communications or drilling conditions recognized by the BHA.

As described herein, in some embodiments, the disengagement downlink communication is a mud pulse. For example, the disengagement downlink communication may be a mud pulse with a disengagement magnitude of a flow rate and/or fluid pressure and a disengagement duration for which the flow rate and/or fluid pressure is maintained. In some embodiments, at least one of the disengagement magnitude and the disengagement duration is unique among downlink communications or drilling conditions recognized by the BHA.

In some embodiments, the disengagement magnitude is a constant disengagement magnitude for the disengagement duration. For example, the disengagement magnitude of a disengagement downlink communication mud pulse is 3000 psi for 60 seconds. In some embodiments, the disengagement magnitude varies during the disengagement duration. For example, the disengagement magnitude may include a maximum value with a substantially continuous decrease in the disengagement magnitude for at least a portion of the disengagement duration. In another example, the disengagement magnitude may include a maximum value with a substantially continuous decrease in the disengagement magnitude for the entire disengagement duration. In a particular example, a disengagement magnitude of a disengagement downlink communication mud pulse is 3000 psi with a 10 psi decrease each second for 60 seconds. In another particular example, a disengagement magnitude of a disengagement downlink communication mud pulse is 2500 psi with a 10 psi increase each second for 60 seconds.

In some embodiments, the disengagement duration is sufficiently long to provide certainty in the signal. In some embodiments, the disengagement duration is no less than 60 seconds. In some embodiments, the disengagement duration is no less than 90 seconds. In some embodiments, the disengagement duration is no less than 120 seconds. In some embodiments, the disengagement duration is sufficiently short to allow rapid communication of disengagement instructions to the control unit to limit and/or prevent undesired drilling during the automated drilling routine. In some embodiments, the disengagement duration is no more than 600 seconds. In some embodiments, the disengagement duration is no more than 450 seconds. In some embodiments, the disengagement duration is no more than 300 seconds.

In some embodiments, the method 642 further includes, based at least partially on the disengagement downlink communication, disengaging the automated drilling routine at 648. In some embodiments, disengaging the automated drilling routine includes providing instructions from the control unit to a directional steering tool to set a DLS to a predetermined value. In some embodiments, the DLS is set to a predetermined value of zero. In some systems, the DLS value is a quantity of degrees per longitudinal distance of the borehole. For example, the DLS value may be 2.0 deg/10 meters of longitudinal distance in the borehole. During at least one test of a drilling system, the automated drilling routine ramped the DLS up to 8.0 deg/10 meters during a stoppage in drilling while a DHDS of the directional steering unit remained set to "drilling". In some embodiments, disengaging the automated drilling routine includes providing instructions from the control unit to a directional steering tool to set a DLS to a pre-determined value, such as 2.0 deg/10 meters. In some embodiments, the pre-determined value is a historical value of the DLS such as the DLS value of 5 minutes prior to disengaging the automated drilling routine.

In some embodiments, disengaging the automated drilling routine includes providing instructions to a downhole tool to set an ROP target to a predetermined value. In some embodiments, the ROP target is set to a predetermined value of zero. In some systems, the ROP target is a distance per unit time of the drill bit. For example, the ROP value may be 1 meter per minute (mpm). In some embodiments, setting the ROP to zero has the effect of informing the directional steering tool and/or other components of the drilling system that the DHDS is "not drilling". In some embodiments, disengaging the automated drilling routine includes providing instructions from the control unit to a directional steering tool to set an ROP target to a pre-determined value, such as 1.5 mpm. In some embodiments, the pre-determined value is a historical value of the ROP such as the ROP value of 5 minutes prior to disengaging the automated drilling routine.

In some embodiments, disengaging the automated drilling routine includes providing instructions from the control unit to the downhole tool to change a DHDS of the downhole tool. For example, disengaging the automated drilling routine may include changing a DHDS to a not drilling state. In some examples, disengaging the automated drilling routine may include changing a DHDS to a reaming state. In some examples, disengaging the automated drilling routine may include changing a DHDS to an off-bottom state.

As described herein, some downhole conditions including both environmental conditions and drilling system conditions (e.g., drilling mechanics, degradation and/or failure of one or more components) can compromise the ability to transmit and/or detect signals in the downhole environment. A confirmation signal transmitted to and/or received by the control unit can provide confirmation of the disengagement downlink communication to limit and/or prevent false positives. In some embodiments, the method 642 optionally comprises receiving, at the control unit, a disengagement downlink confirmation having a confirmation magnitude and a confirmation duration, wherein the confirmation magnitude is less than the disengagement magnitude. In some embodiments, the confirmation duration is the same as the disengagement duration. In some embodiments, the confirmation duration is greater than the disengagement duration. In some embodiments, the confirmation duration is less than the disengagement duration. By including a disengagement downlink confirmation in the method to confirm the disengagement downlink communication, disengagement downlink confirmation adds additional confidence to the disengagement downlink communication, allowing the confirmation duration to be less than the disengagement duration.

Figure 7:
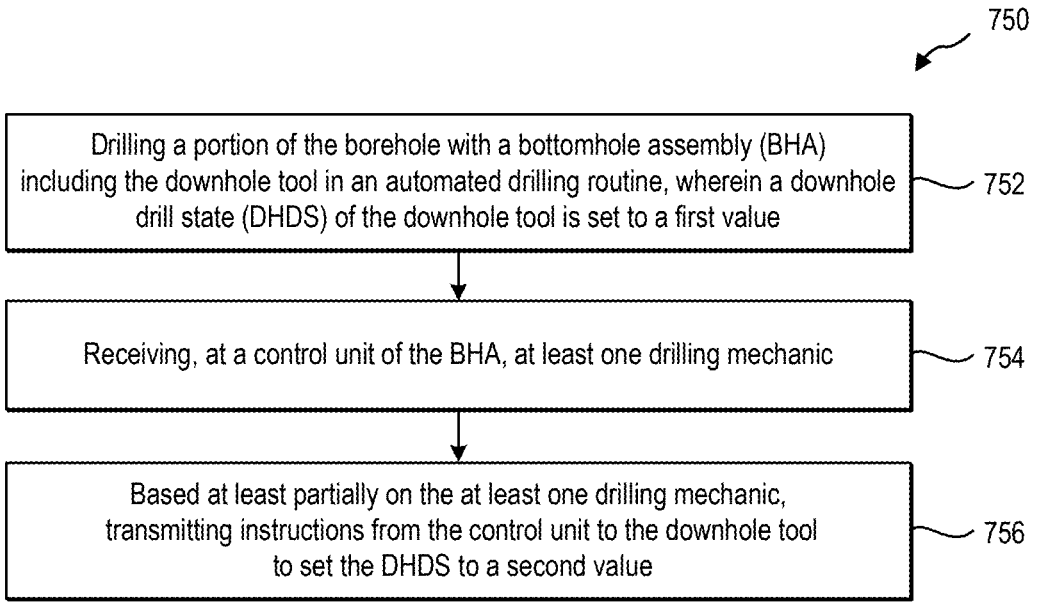
FIG. 7 is a flowchart illustrating a method of controlling a downhole tool, according to some embodiments of the present disclosure.

FIG. 7 is a flowchart illustrating another embodiment of a method 750 of controlling a downhole tool. In some embodiments, the method 750 includes drilling a portion of the borehole with a BHA including the downhole tool in an automated drilling routine, wherein a DHDS of the downhole tool is set to a first value, at 752. For example, the DHDS may be set to a drilling state while drilling the portion of the borehole. In some examples, the DHDS may be set to other states, and the method 750 may change the DHDS to match the detected conditions, as will be described.

In some embodiments, the method 750 includes receiving, at a control unit of the BHA, at least one drilling mechanic at 754. In some embodiments, the at least one drilling mechanic is detected or measured by the control unit. measuring or detecting the zero pulse of the flow rate, fluid pressure, or RPM. In some embodiments, the at least one drilling mechanic is detected or measured by a sensor or another component of the BHA, such as an MWD. The sensor or another component of the BHA may then transmit the measured value of the at least one drilling mechanic to the control unit. In some embodiments, the at least one drilling mechanic is received at the control unit by a sensor or another component of the BHA, such as an MWD, identifying the at least one drilling mechanic and transmitting a signal indicating the detection of the at least one drilling mechanic to the control unit. For example, the MWD may measure an RPM of the BHA and transmit a signal to the control unit indicating a stick-slip condition without transmitting the RPM value, itself.

In some embodiments, the method 750 includes, based at least partially on the at least one drilling mechanic, transmitting instructions from the control unit to the downhole tool to set the DHDS to a second value at 756. In some embodiments, the at least one drilling mechanic is a collar RPM. For example, a collar RPM that is other than an expected drilling RPM may cause the control unit to change the DHDS to a not drilling state. In some examples, the control unit may determine that the detected or received collar RPM corresponds to another DHDS, such as reaming or off-bottom idle.

In some embodiments, the at least one drilling mechanic is a lower torquer RPM. As the lower torquer in the drill string is associated with the drilling RPM of the drill bit, a lower torquer RPM that is other than an expected drilling RPM of the lower torquer may cause the control unit to change the DHDS to a not drilling state. In some examples, the control unit may determine that the detected or received lower torquer RPM corresponds to another DHDS, such as reaming or off-bottom idle. In some examples, the lower torquer RPM is based at least partially on a drilling fluid flow rate through the lower torquer, and the lower torquer RPM is, therefore, a proxy value for the drilling fluid flow rate through the lower torquer.

In some embodiments, the at least one drilling mechanics is a measured drilling fluid flow rate through at least a portion of the drilling system and/or drill string. In some embodiments, the at least one drilling mechanic is a ratio of lower torquer flow rate relative to a drill string flow rate or a ratio of lower torquer fluid pressure relative to the drill string fluid pressure. For example, during drilling, a steady state flow of drilling fluid is expected through the drill string and lower torquer. In some embodiments, a difference between a flow rate and/or fluid pressure through the lower torquer and through the drill string indicates a jam or other issue with the lower torquer. Similar to the stick-slip detection described above, the jam or other issue with the lower torquer requires anti-jam measures that result in the cessation of drilling.

In some embodiments, the at least one drilling mechanic is a pulse width modulation (PWM). When drilling under normal conditions, the channel PWM is between 30% and 50%. When jamming of at least a portion of the drilling string occurs, the PWM approaches and/or is 100. As described above, when jamming occurs, an associated stop in drilling occurs to apply anti-jamming procedures. In some embodiments, fluctuations of PWM between 40 and 100 can occur. For example, fluctuations can indicate debris in the drilling fluid but drilling can continue. In some embodiments, the at least one drilling mechanic, therefore, includes a drilling mechanic duration where the control unit is not transmitting instructions unless the at least one drilling mechanic is outside of a pre-determined range for a pre-determined period of time.

In at least one embodiment, according to the present disclosure, a system and/or method of controlling a downhole tool in a downhole environment allows more reliable and faster control and/or disengagement of automated drilling routines. While automated drilling routines can improve drilling, the conditions under which the automated drilling routines experience the greatest challenge can render communications the most challenging, as well.

Embodiments of the present disclosure generally relate to devices, systems, and methods for controlling a downhole tool in a downhole environment. In some embodiments, methods and systems, according to the present disclosure, include a control unit in the downhole environment receiving or detecting a communication to control at least a portion of a bottomhole assembly. More particularly, the control unit sends transmissions to at least one other component of the bottomhole assembly based on determining a downhole drill state (DHDS) of the drilling system.

Automated drilling routines based on one or more pre-determined stages or a pre-determined well plan can limit downhole communications and increase uptime of the drilling system. However, downhole environments are variable and the effects on the drilling system and components of the drilling system can be unexpected. Furthermore, communication with a bottomhole assembly (BHA) or other downhole components of the drill string can present a challenge when hundreds or thousands of meters from the surface controls. Reliable, fast, and robust control of engagement and disengagement of the automated drilling routines is desirable.

In some embodiments, an automated drilling routine automatically adjusts one or more operating parameter of a downhole component, such as a directional steering tool, turbine, or mud motor to change a rate of penetration (ROP) of a drill bit or a direction and/or radius of curvature of the borehole during drilling. For example, an automated drilling routine may target a pre-determined azimuth and/or inclination for the borehole being drilled. The directional steering tool may actuate steering pads or other features to urge the drill bit in the direction of the target azimuth and/or inclination. By acting over a period of time, a gradual curve can be created in the borehole to meet the target azimuth and/or inclination before a target location is reached and/or a target distance is drilled.

In some embodiments, the directional steering tool and/or other downhole components can measure the rotational orientation of the directional steering tool and/or other downhole components but may be uninformed of the longitudinal position of the BHA in the borehole and the actual ROP (and longitudinal speed) of the BHA and/or drill string through the formation. In the event that the directional steering tool and/or other downhole components are not changing orientation when expected (i.e., not moving through a curve), the automated drilling routine may attempt to compensate for the difference between the targeted changes and the measured changes by adjusting (e.g., increasing) a targeted dogleg severity (DLS) and/or ROP.

More particularly, some automated drilling routines include ramping ROP and/or DLS based on time and progress toward a target value or target location. If the drill string is not advancing (e.g., during connection of a stand, idling, rotating off-bottom, or reaming), the drilling system can continue ramping the DLS and ROP progressive more and more, causing a runaway DLS and/or runaway ROP. In some examples, the directional steering tool and/or other downhole components can erroneously determine the BHA is not effectively turning through the formation when the drilling system is, in actuality, not drilling, at all. In some instances, transmitting a conventional downlink communication to change the automated drilling routine settings and/or reset values can require a 25-minute sequence of downlink communications. Determining when the drilling system is not drilling the formation and changing a DHDS of the drilling system and/or BHA without a lengthy downlink communication can save time and prevent unintended changes to the DLS and/or ROP.

In some embodiments, a drilling rig or other component of the drilling system at surface transmits a single downlink communication to the control unit. The single downlink communication instructs the control unit to disengage at least one active automated drilling routine. For example, the single downlink communication may be a unique downlink communication that is discernable by the control unit as a complete downlink communication, and, in response to the single downlink communication, the control unit disengages the automated drilling routine and sets the directional steering tool and/or other downhole components to manual control to await further downlink communications. In some embodiments, the control unit disengages the automated drilling routine and changes a DHDS of the directional steering tool and/or other downhole components. In at least one example, a DHDS of the directional steering tool and/or other downhole components instructs the directional steering tool and/or other downhole components when the drilling system is drilling or not drilling. In at least one example, the DHDS has further non-drilling states, such as instructing the directional steering tool and/or other downhole components when the drilling system is reaming or connecting a stand of pipe to the drill string.

In at least one embodiment, the single downlink communication is a rotations-per-minute (RPM) pulse. For example, an RPM pulse can allow a downlink communication when drilling fluid (e.g., mud) flow rate and/or pressure is unreliable. In some examples, an operator may need to stop an automated drilling routine because of a loss of control of the mud flow rate and/or pressure. A single RPM pulse, such as a pre-determined RPM for a pre-determined duration (200 RPM for 60 seconds), can allow the operator to transmit a disengagement command to the control unit and BHA even when mud pulses are unreliable or impossible.

In at least one embodiment, the single downlink communication is a mud pulse. For example, a mud pulse can allow a downlink communication when an RPM pulse is unreliable. In some examples, an operator may need to stop an automated drilling routine because of stick-slip mechanics or other drilling mechanics that affect the rotational speed of at least a portion of the downhole assembly. In such an example, the challenge causing the need to disengage the automated drilling routine also can inhibit conventional communications. A single mud pulse, such as a pre-determined mud pressure for a pre-determined duration (e.g., 2000 pounds per square inch for 60 seconds), can allow the operator to transmit a disengagement command to the control unit and BHA even when RPM pulses are unreliable or impossible.

In some embodiments, the control unit determines and changes a DHDS based on one or more drilling conditions measured or received at the control unit in the downhole environment without a downlink communication. For example, the control unit may receive or detect a collar RPM value proximate to the BHA and determine, based at least partially on the collar RPM value, that a connection of additional drill pipe is being made at the drilling rig. The control unit may change a DHDS value of a directional steering tool and/or other downhole components to pause or terminate an automated drilling routine. For example, the control unit may transmit instructions to the directional steering tool to stop actuation of steering pads while the DHDS is set to a not drilling value. In some examples, the control unit may transmit instructions to the directional steering tool to limit and/or prevent any changes to a DLS while the DHDS is set to a not drilling value. In some examples, the control unit may transmit instructions to the directional steering tool to set a DHDS value of the directional steering tool to a not drilling value, and the directional steering tool changes one or more operations of the directional steering tool based at least partially on the DHDS value.

As described herein, an operator may disengage an automated drilling routine due to measured drilling mechanics in the downhole environment, such as stick-slip mechanics or other measured vibrations or variations in drill string RPM. In some embodiments, the control unit receives and/or measures one or more drilling mechanics values and determines a DHDS of the drilling system. For example, a lower torquer of the drill string receives mud flow and converts the fluid pressure to torque on a lower portion of the drill string. The torque generated by the lower torquer rotates the drill bit in addition to any surface (e.g., drilling rig) RPM. In some embodiments, the control unit receives a torque and/or flow rate of drilling fluid through the lower torquer. When the lower torquer flow rate is different from an expected drilling flow rate or a downlink flow rate (i.e., mud pulses), the control unit may determine that a stick-slip condition is occurring. As anti-jamming procedures require temporary cessation of on-bottom drilling, the control unit determines the DHDS value to be "not drilling".

In some embodiments, the BHA includes a control unit configured to receive one or more of directional information, operating conditions, environmental conditions, fluid measurements, drilling mechanics information, or other status information. In some embodiments, the control unit is in data communication with at least one sensor (e.g., an MWD including one or more sensors) and a directional steering tool. In some embodiments, the control unit is integrated with the MWD and/or the directional steering tool. The control unit includes a processor and a hardware storage device in data communication with the processor. The hardware storage device has instructions stored thereon that, when executed by the processor, cause the BHA to perform at least a portion of any method described herein.

In some embodiments, the hardware storage device has a plurality of stages and/or well plans stored thereon. In some embodiments, the well plan is loaded to the hardware storage device at the surface of the drilling system prior to running the BHA (including the control unit) downhole. In some embodiments, the well plan includes a plurality of stages of the well plan. The control unit obtains at least one of the directional information, operating conditions, environmental conditions, fluid measurements, drilling mechanics information, or other status information from one or more sensors of the BHA. In at least one example, the sensors are in or part of the MWD.

A formation measurement is, in some examples, a measurement of at least one property of the formation through which the BHA is drilling or otherwise located. For example, a formation measurement includes a formation fluid composition, a formation solids composition (e.g., geochemistry), a formation hardness, a formation porosity, a formation fluid flow rate, a formation homogeneity, etc. In some embodiments, the formation measurement is made by one or more sensors of the BHA. In some embodiments, the formation measurement is made by sensors in the drill bit. In some embodiments, the formation measurement is made by sensors in the MWD. In some embodiments, the formation measurement is made by sensors in the directional steering tool.

An environmental measurement is, in some examples, a measurement of at least one property of the downhole environment that may or may not be related to the formation through which the BHA drills or is located. For example, an environmental measurement may include temperature, pressure, or other measurements that are not formation measurements but inform the drilling system of downhole conditions. In some embodiments, the environmental measurement is made by one or more sensors of the BHA. In some embodiments, the environmental measurement is made by sensors in the drill bit. In some embodiments, the environmental measurement is made by sensors in the MWD. In some embodiments, the environmental measurement is made by sensors in the directional steering tool.

In some embodiments, the BHA uses the plurality of stages and/or well plan stored locally on the BHA to determine target values, including target ROP and target DLS, of automated drilling routines. In some embodiments, the well plan includes a plurality of stages with transitions therebetween. For example, the well plan may include a curved stage and/or a linear stage. In some embodiments, the well plan includes a plurality of curved stages and linear stages. In some embodiments, the well plan includes at least one vertical stage. In some embodiments, the well plan includes a landing stage. The directional steering tool and other components of the drill string directs the BHA and drill bit through the formation according to the inclination, azimuth, dogleg severity, rate of penetration, axial length along the stage, and other parameters of the well plan. Determining the location of the BHA in the well plan and/or a stage of the well plan can improve the accuracy of the drilling system.

A curved stage is any stage of the well plan in which at least one of the inclination and the azimuth of the borehole changes along a length of the stage. It should be understood that in some embodiments of a curved stage the inclination is substantially constant and the azimuth of the borehole changes. In some embodiments, both the inclination and the azimuth of the borehole changes in the curved stage.

A linear stage is any stage of the well plan in which the inclination and azimuth of the borehole remains constant along the length of the stage. In some embodiments, a linear stage is a vertical stage of the well plan in which the inclination is substantially vertical relative to a direction of gravity. For example, a vertical stage may be an initial stage from the surface. In some embodiments, a linear stage of the well plan is a directional stage in which the inclination and azimuth are substantially constant, while the inclination is non-vertical, creating a lateral net movement of the borehole along the length of the directional stage relative to the direction of gravity.

In some embodiments, the well plan includes a landing stage. In some embodiments, the landing stage is a curved stage in which the borehole attains a substantially horizontal orientation relative to the direction of gravity. In some embodiments, the landing stage is a final stage of the well plan.

In some embodiments, the drilling system can communicate downhole with the control unit and/or BHA by mud pulses. For example, a drilling fluid or mud flows downward through the drill string to the control unit and/or BHA as described herein. By varying a flow rate and/or a fluid pressure of the drilling fluid, the drilling rig at the surface of the drilling system can transmit instructions to the control unit and/or BHA. In a conventional system, the downlink communication includes a plurality of mud pulses in the downhole direction, where each mud pulse is of varying duration to communicate or select settings in the BHA. In some examples, the borehole and/or drill string can be long, introducing fluidic drag into the mud pulses, requiring each mud pulse to be a minute or longer. A sequence of mud pulses, therefore, can take several minutes or longer to communicate a relatively simple change to BHA settings.

In some embodiments, the drilling system can communicate downhole with the control unit and/or BHA by RPM pulses. For example, the drilling rig applies a torque to change the RPM of the drill string to communicate with the control unit and/or BHA. By varying an RPM of the drill string through a series of changes or at a particular RPM, the drilling rig at the surface of the drilling system can transmit instructions to the control unit and/or BHA. In a conventional system, the downlink communication includes a plurality of RPM pulses, where each RPM pulses is of varying duration and/or RPM to communicate or select settings in the BHA. In some examples, the borehole and/or drill string can be long, introducing significant torsional elasticity, fluidic drag, friction with a borehole wall and other variables into the communication of the transmission of the RPM pulse in the downhole direction. The delay and/or noise (e.g., torsional oscillations) in the transmission of the RPM pulses can require each RPM pulse to be a minute or longer to effectively communicate the signal to the control unit and/or BHA. A sequence of RPM pulses, therefore, can take several minutes or longer to communicate a relatively simple change to BHA settings.

In some embodiments, a method of controlling a downhole tool includes drilling a portion of the borehole with a BHA including a downhole tool in an automated drilling routine. In some embodiments, after drilling the portion of the borehole, the method includes receiving, at the control unit of the BHA, a disengagement downlink communication. In some embodiments, the disengagement downlink communication has a pre-determined disengagement magnitude and disengagement duration. In some embodiments, at least one of the disengagement magnitude and the disengagement duration is unique among downlink communications recognized by the BHA. For example, the disengagement downlink communication may have a disengagement magnitude that is greater than any other recognized downlink communication. In at least one example, the disengagement magnitude is at least 2000 psi. In at least one example, the disengagement magnitude is at least 200 RPM.

As described herein, in some embodiments, the disengagement downlink communication is an RPM pulse. For example, the disengagement downlink communication may be an RPM pulse with a disengagement magnitude of an RPM value and a disengagement duration for which the RPM value is maintained. In some embodiments, at least one of the disengagement magnitude and the disengagement duration is unique among downlink communications or drilling conditions recognized by the BHA.

As described herein, in some embodiments, the disengagement downlink communication is a mud pulse. For example, the disengagement downlink communication may be a mud pulse with a disengagement magnitude of a flow rate and/or fluid pressure and a disengagement duration for which the flow rate and/or fluid pressure is maintained. In some embodiments, at least one of the disengagement magnitude and the disengagement duration is unique among downlink communications or drilling conditions recognized by the BHA.

In some embodiments, the disengagement magnitude is a constant disengagement magnitude for the disengagement duration. For example, the disengagement magnitude of a disengagement downlink communication mud pulse is 3000 psi for 60 seconds. In some embodiments, the disengagement magnitude varies during the disengagement duration. For example, the disengagement magnitude may include a maximum value with a substantially continuous decrease in the disengagement magnitude for at least a portion of the disengagement duration. In another example, the disengagement magnitude may include a maximum value with a substantially continuous decrease in the disengagement magnitude for the entire disengagement duration. In a particular example, a disengagement magnitude of a disengagement downlink communication mud pulse is 3000 psi with a 10 psi decrease each second for 60 seconds. In another particular example, a disengagement magnitude of a disengagement downlink communication mud pulse is 2500 psi with a 10 psi increase each second for 60 seconds.

In some embodiments, the disengagement duration is sufficiently long to provide certainty in the signal. In some embodiments, the disengagement duration is no less than 60 seconds. In some embodiments, the disengagement duration is no less than 90 seconds. In some embodiments, the disengagement duration is no less than 120 seconds. In some embodiments, the disengagement duration is sufficiently short to allow rapid communication of disengagement instructions to the control unit to limit and/or prevent undesired drilling during the automated drilling routine. In some embodiments, the disengagement duration is no more than 600 seconds. In some embodiments, the disengagement duration is no more than 450 seconds. In some embodiments, the disengagement duration is no more than 300 seconds.

In some embodiments, the method further includes, based at least partially on the disengagement downlink communication, disengaging the automated drilling routine. In some embodiments, disengaging the automated drilling routine includes providing instructions from the control unit to a directional steering tool to set a DLS to a predetermined value. In some embodiments, the DLS is set to a predetermined value of zero. In some systems, the DLS value is a quantity of degrees per longitudinal distance of the borehole. For example, the DLS value may be 2.0 deg/10 meters of longitudinal distance in the borehole. During at least one test of a drilling system, the automated drilling routine ramped the DLS up to 8.0 deg/10 meters during a stoppage in drilling while a DHDS of the directional steering unit remained set to "drilling". In some embodiments, disengaging the automated drilling routine includes providing instructions from the control unit to a directional steering tool to set a DLS to a pre-determined value, such as 2.0 deg/10 meters. In some embodiments, the pre-determined value is a historical value of the DLS such as the DLS value of 5 minutes prior to disengaging the automated drilling routine.

In some embodiments, disengaging the automated drilling routine includes providing instructions to a downhole tool to set an ROP target to a predetermined value. In some embodiments, the ROP target is set to a predetermined value of zero. In some systems, the ROP target is a distance per unit time of the drill bit. For example, the ROP value may be 1 meter per minute (mpm). In some embodiments, setting the ROP to zero has the effect of informing the directional steering tool and/or other components of the drilling system that the DHDS is "not drilling". In some embodiments, disengaging the automated drilling routine includes providing instructions from the control unit to a directional steering tool to set an ROP target to a pre-determined value, such as 1.5 mpm. In some embodiments, the pre-determined value is a historical value of the ROP such as the ROP value of 5 minutes prior to disengaging the automated drilling routine.

In some embodiments, disengaging the automated drilling routine includes providing instructions from the control unit to the downhole tool to change a DHDS of the downhole tool. For example, disengaging the automated drilling routine may include changing a DHDS to a not drilling state. In some examples, disengaging the automated drilling routine may include changing a DHDS to a reaming state. In some examples, disengaging the automated drilling routine may include changing a DHDS to an off-bottom state.

As described herein, some downhole conditions including both environmental conditions and drilling system conditions (e.g., drilling mechanics, degradation and/or failure of one or more components) can compromise the ability to transmit and/or detect signals in the downhole environment. A confirmation signal transmitted to and/or received by the control unit can provide confirmation of the disengagement downlink communication to limit and/or prevent false positives. In some embodiments, the method optionally comprises receiving, at the control unit, a disengagement downlink confirmation having a confirmation magnitude and a confirmation duration, wherein the confirmation magnitude is less than the disengagement magnitude. In some embodiments, the confirmation duration is the same as the disengagement duration. In some embodiments, the confirmation duration is greater than the disengagement duration. In some embodiments, the confirmation duration is less than the disengagement duration. By including a disengagement downlink confirmation in the method to confirm the disengagement downlink communication, disengagement downlink confirmation adds additional confidence to the disengagement downlink communication, allowing the confirmation duration to be less than the disengagement duration.

In some embodiments, a method of controlling a downhole tool includes drilling a portion of the borehole with a BHA including the downhole tool in an automated drilling routine, wherein a DHDS of the downhole tool is set to a first value. For example, the DHDS may be set to a drilling state while drilling the portion of the borehole. In some examples, the DHDS may be set to other states, and the method may change the DHDS to match the detected conditions, as will be described.

In some embodiments, the method includes receiving, at a control unit of the BHA, at least one drilling mechanic. In some embodiments, the at least one drilling mechanic is detected or measured by the control unit, measuring or detecting the zero pulse of the flow rate, fluid pressure, or RPM. In some embodiments, the at least one drilling mechanic is detected or measured by a sensor or another component of the BHA, such as an MWD. The sensor or another component of the BHA may then transmit the measured value of the at least one drilling mechanic to the control unit. In some embodiments, the at least one drilling mechanic is received at the control unit by a sensor or another component of the BHA, such as an MWD, identifying the at least one drilling mechanic and transmitting a signal indicating the detection of the at least one drilling mechanic to the control unit. For example, the MWD may measure an RPM of the BHA and transmit a signal to the control unit indicating a stick-slip condition without transmitting the RPM value, itself.

In some embodiments, the method includes, based at least partially on the at least one drilling mechanic, transmitting instructions from the control unit to the downhole tool to set the DHDS to a second value. In some embodiments, the at least one drilling mechanic is a collar RPM. For example, a collar RPM that is other than an expected drilling RPM may cause the control unit to change the DHDS to a not drilling state. In some examples, the control unit may determine that the detected or received collar RPM corresponds to another DHDS, such as reaming or off-bottom idle.

In some embodiments, the at least one drilling mechanic is a lower torquer RPM. As the lower torquer in the drill string is associated with the drilling RPM of the drill bit, a lower torquer RPM that is other than an expected drilling RPM of the lower torquer may cause the control unit to change the DHDS to a not drilling state. In some examples, the control unit may determine that the detected or received lower torquer RPM corresponds to another DHDS, such as reaming or off-bottom idle. In some examples, the lower torquer RPM is based at least partially on a drilling fluid flow rate through the lower torquer, and the lower torquer RPM is, therefore, a proxy value for the drilling fluid flow rate through the lower torquer.

In some embodiments, the at least one drilling mechanics is a measured drilling fluid flow rate through at least a portion of the drilling system and/or drill string. In some embodiments, the at least one drilling mechanic is a ratio of lower torquer flow rate relative to a drill string flow rate or a ratio of lower torquer fluid pressure relative to the drill string fluid pressure. For example, during drilling, a steady state flow of drilling fluid is expected through the drill string and lower torquer. In some embodiments, a difference between a flow rate and/or fluid pressure through the lower torquer and through the drill string indicates a jam or other issue with the lower torquer. Similar to the stick-slip detection described above, the jam or other issue with the lower torquer requires anti-jam measures that result in the cessation of drilling.

In some embodiments, the at least one drilling mechanic is a pulse width modulation (PWM). When drilling under normal conditions, the channel PWM is between 30% and 50%. When jamming of at least a portion of the drilling string occurs, the PWM approaches and/or is 100. As described above, when jamming occurs, an associated stop in drilling occurs to apply anti-jamming procedures. In some embodiments, fluctuations of PWM between 40 and 100 can occur. For example, fluctuations can indicate debris in the drilling fluid, but drilling can continue. In some embodiments, the at least one drilling mechanic, therefore, includes a drilling mechanic duration where the control unit is not transmitting instructions unless the at least one drilling mechanic is outside of a pre-determined range for a pre-determined period of time.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about", "substantially", or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A method of controlling a downhole tool, the method comprising:

drilling a portion of a borehole with a bottomhole assembly (BHA) including the downhole tool in an automated drilling routine, wherein a downhole drill state (DHDS) of the downhole tool is set to a first value;

receiving, at a control unit of the BHA, at least one drilling mechanic, wherein the at least one drilling mechanic is a lower torquer RPM; and based at least partially on the at least one drilling mechanic, transmitting instructions from the control unit to the downhole tool to set the DHDS to a second value.

2. The method of claim 1, wherein the first value of the DHDS is a drilling state and based at least partially on the at least one drilling mechanic, the second value is a reaming state.

3. A method of controlling a downhole tool, the method comprising:

drilling a portion of a borehole with a bottomhole assembly (BHA) including the downhole tool in an automated drilling routine, wherein a downhole drill state (DHDS) of the downhole tool is set to a first value;

receiving, at a control unit of the BHA, at least one drilling mechanic, wherein the at least one drilling mechanic is a pulse width modulation (PWM); and based at least partially on the at least one drilling mechanic, transmitting instructions from the control unit to the downhole tool to set the DHDS to a second value.

4. The method of claim 3, wherein the first value of the DHDS is a drilling state and based at least partially on the at least one drilling mechanic, the second value is a reaming state.

5. A method of controlling a downhole tool, the method comprising:

drilling a portion of a borehole with a bottomhole assembly (BHA) including the downhole tool in an automated drilling routine, wherein a downhole drill state (DHDS) of the downhole tool is set to a first value;

receiving, at a control unit of the BHA, at least one drilling mechanic, wherein the at least one drilling mechanic is a ratio of lower torquer flow rate relative to a drill string flow rate; and based at least partially on the at least one drilling mechanic, transmitting instructions from the control unit to the downhole tool to set the DHDS to a second value.

6. The method of claim 5, wherein the first value of the DHDS is a drilling state and based at least partially on the at least one drilling mechanic, the second value is a reaming state.

* * * * *